US005365958A

United States Patent [19]

Stuhlmacher, II

[11] Patent Number: 5,365,958

[45] Date of Patent: Nov. 22, 1994

[54] RAZOR CLEANING DEVICE

[76] Inventor: Glen Stuhlmacher, II, 45 Cuenca Ct., San Ramon, Calif. 94583

[21] Appl. No.: 44,302

[22] Filed: Apr. 7, 1993

[51] Int. Cl.[5] ..... B08B 3/02

[52] U.S. Cl. ..... 134/44; 134/166 R; 134/182; 134/201

[58] Field of Search ..... 134/44, 166 R, 201, 134/182, 183; 251/354, 353; 239/579, 576, 577

[56] References Cited

U.S. PATENT DOCUMENTS

| | | | |
|---|---|---|---|
| 695,697 | 3/1902 | O'Lally | 251/353 X |
| 4,027,387 | 6/1977 | Kellis | 134/182 X |
| 4,480,387 | 11/1984 | d'Alayer de Costemore d'Arc | 134/183 |
| 4,838,949 | 6/1989 | Durgrot | 134/182 |
| 4,941,492 | 7/1990 | Morgan | 134/182 |
| 5,083,751 | 1/1992 | Chaffin | 251/354 X |
| 5,284,170 | 2/1994 | Larsen | 134/166 R |

FOREIGN PATENT DOCUMENTS

| | | | |
|---|---|---|---|
| 936780 | 11/1973 | Canada | 134/44 |
| 2425833 | 1/1980 | France | 134/44 |
| 328524 | 8/1937 | Italy | 134/44 |

*Primary Examiner*—Frankie L. Stinson
*Attorney, Agent, or Firm*—Mark Lauer

[57] ABSTRACT

A razor cleaning device is attached to a source of tap water either at a faucet spout or independently of a faucet. The device contains a nozzle for directing the tap water to a location to which blades of a razor are guided for cleaning. The outlet of the nozzle is of a relatively small area, causing the tap water exiting from the nozzle to be of a high pressure. The device contains a valve which remains closed unless the razor blades are in place for cleaning, the closed valve causing the pressure at the valve to increase and also conserving water. The device contains a notched leaf for guiding the razor blades to the location for cleaning, and a lever which is pressed upon by the razor when the blades are in that location, the lever causing the valve to open and a high pressure blast of water to exit the nozzle, cleaning the blades.

12 Claims, 3 Drawing Sheets

RAZOR CLEANING DEVICE

BACKGROUND OF THE INVENTION

1. Field of the Invention

The present invention relates generally to a device for rinsing razor blades. More particularly, this invention relates to a device that, upon presentation of a razor to the device, automatically activates a high pressure shower of water for cleaning shaving debris from the razor.

2. Description of the Prior Art

The use of razors to shave facial or body hair by pulling razor blades across a body surface is well known. The use is typically accomplished with the aid of a lubricating fluid, and with the additional aid of a source of water for cleaning the blade or blades after each pass with the razor has clogged the blade or blades with accumulated lubricating fluid and hair. As it is inconvenient and awkward to turn the water source on and off again with each pass of the razor, the water source is often left on, resulting in a waste of water and, since the water is usually heated, a waste of energy. The aggregation of this waste by millions of individuals on a daily basis is no doubt substantial.

The popularity of parallel blade shaving razors, such as those sold under the trademark "TRAC-II", has compounded this problem, as the small spaces between and around the parallel blades provide both an attractive repository for shaving debris and an area that is difficult to clean. Additionally, the parallel blades are encased within the shaving head and not removable from the head for cleaning, unlike a traditional safety razor. As a result, the parallel blade shaving razors can require even more water for cleaning.

One approach to cleaning shaving razors is the use of brushes, such as that illustrated in U.S. Pat. No. 4,890,348. Unfortunately, the brush bristles can be cut by the razor blade or blades and can themselves become lodged between and around the razor blades. Conversely, when the bristles are too tough to be cut by the blades they may instead damage the blades. And the cleaning device disclosed in the above referenced patent must still be augmented with watering from a faucet that, as above, is either wasteful or inconvenient.

Another approach to cleaning shaving razors is illustrated in U.S. Pat. No. 4,941,492, which discloses a device that is attached to a faucet and that provides a conduit for the water flowing from the faucet to exit through a number of small jets, thereby increasing the water pressure, the jets) directing the water into a cavity that is sized to receive a razor head. While the increased water pressure caused by this device is an improvement over the pressure available in most bathroom sinks, several problems remain.

First, as with all other prior art known to applicant, the user of the device is faced with a choice of turning the device on and off with each pass of the razor or leaving the device running constantly. Turning the water faucet on and off may require several turns of a knob each time the faucet is turned on and several turns of the knob to turn the faucet off again. To perform this requires the use of another hand beside the hand holding the razor, which presents a serious obstacle for people that are either physically handicapped or temporarily handicapped by using their other hand for other purposes, such as holding shaving lubricant. Moreover, each time the faucet is turned off the water drains from the conduit between the faucet valve and the jets, causing an air pocket to form that must be expelled each time the faucet is turned on before water exits the jets. And the jets will not spray at full pressure until the faucet valve is completely opened.

The alternative method of allowing the water to run constantly while shaving wastes water and energy in an amount that may be more or less than that wasted by running the water constantly at a faucet unadorned with the device. The spray from the jets during the period that the razor head is not within the device may, however, splash out of the sink basin and damage the clothes of the person shaving or other nearby items. Also, the steam from this constant spray may fog the mirror used by the person shaving, making shaving more difficult.

Second, the cavity into which the razor head must be inserted for cleaning is difficult to use and may damage the razor blades. The cleaning cavity is sized so as to snugly receive an ordinary safety razor head of the cooperating parallel blade type; care and skill must therefore be used each time the razor head is to be inserted into the cavity. The razor blades, the cleaning device, or both may be damaged each time the razor hits the edge of any of the four walls defining the cavity. Damage to the razor blades could result in the razor cutting the person shaving and, of course, in the need to replace the razor blades.

Third, device cannot be used separately from a faucet, as the device contains no valve or control other than that provided by the faucet. This may require removal of the faucet aerator each time the device is attached to the faucet, or may require a specially sized aerator to mate with the device. While the device is attached to the faucet, of course, the faucet cannot be used independently of the device, making it difficult, for example, for one person to use the faucet to brush his or her teeth while another is using the device to shave.

STATEMENT OF THE OBJECTS

It is an object of the present invention to provide a razor cleaning device which facilitates cleaning razors of the type having parallel cooperating blades.

It is also an object of the present invention to achieve the above object with a device which is also suitable for cleaning double-edged, single blade safety razors.

It is another object of this invention to achieve the above objects with a device that is convenient to use yet which saves water and energy by using water only when the razor is presented to the device for cleaning.

It is yet another object of this invention to achieve the above objects without damaging the razor or the cleaning device.

SUMMARY OF THE INVENTION

The foregoing objects and other objects and advantages which shall become apparent from the description of the preferred embodiment are attained in a device which produces a high pressure blast of fluid upon presentation of a razor to the device, the blast of fluid directed to a location to which the device has guided a blade or blades of the razor for cleaning. Removal of the razor from the device stops the flow of fluid, conserving the fluid and allowing the pressure to build for the next blast. Since the fluid used is typically hot water, use of the device can result in a savings of both water and the energy used to heat and pump the water.

The device is comprised of a leaf containing a notch that is sized to fit a handle of a razor while a head of the razor is restrained behind the leaf. With the razor thus hooked and channeled by the notch to a location at which the blade or blades are to be cleaned, the razor presses upon a lever which opens a valve and releases the fluid. The fluid travels through a nozzle which directs the fluid to the location of the razor blade or blades. The fluid exits the nozzle through a plurality of jets that, in sum, have an area that is small relative an inlet of the nozzle, thereby increasing the pressure of the fluid.

The device can be attached to a spout of an existing faucet, typically by threading it into a threaded cylindrical aperture in the spout, or can be attached to a fluid source that supplies fluid to the faucet separately. The lever can be attached to the leaf or move independently from the leaf, or the nozzle itself can move and operate as the lever.

DETAILED DESCRIPTION OF THE PREFERRED EMBODIMENT

Figure 1:
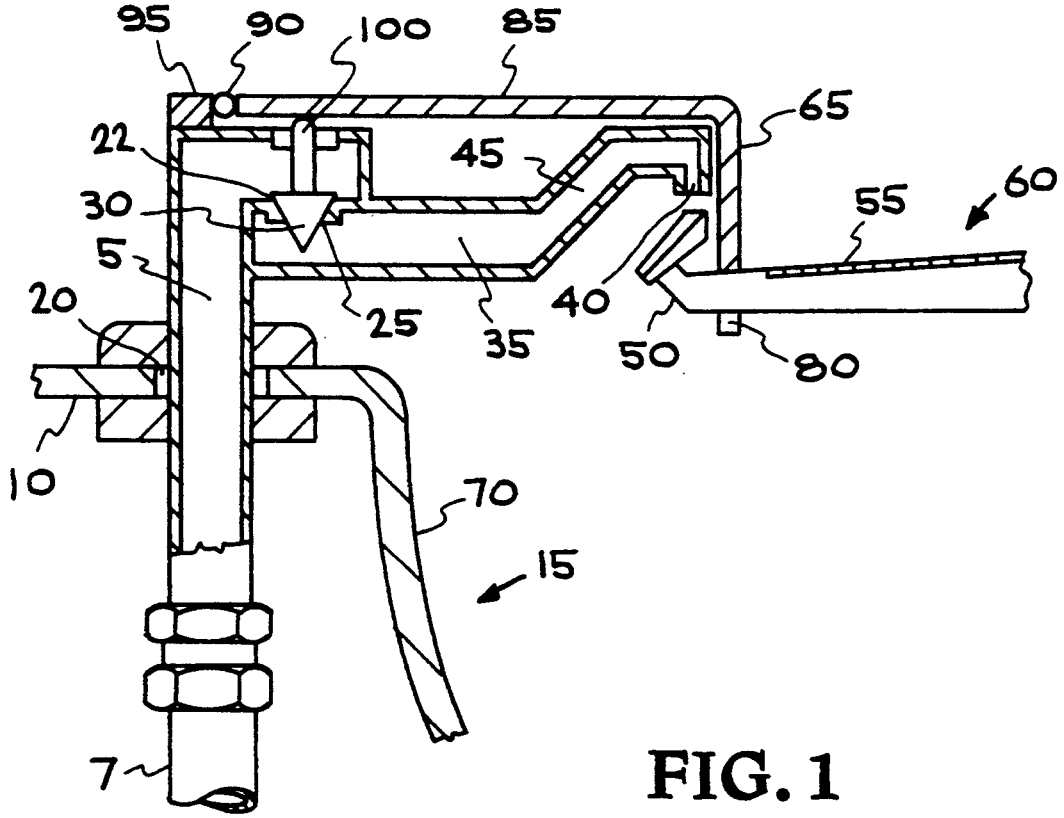
FIG. 1 is a side view of a first embodiment of this invention.

Referring now to FIG. 1, a conduit 5 is attached to a hot water source 7 for a sink beneath a rear rim 10 of a sink basin 15. The conduit 5 fits through the rear rim 10 of the sink basin 15 at an aperture 20 of the rim. The conduit 5 is bent, and ends with an outlet 22 which contains a valve 30.

Attached to the conduit 5 is a nozzle 35. An inlet aperture 25 of the nozzle 35 is in fluid communication with the outlet 22 of the conduit 5. The nozzle has an outlet aperture 40 which faces generally downward, so as to direct a shower of water onto a head 50 of a razor 55, in order to wash razor blades contained within the head. The nozzle 35 contains an upward sloping segment 45 that is adjacent to the outlet aperture 40, so as to maintain a reservoir of fluid in the nozzle when the valve 30 is closed and fluid flow from the conduit 5 has ceased. The inlet aperture 25 is larger in area than the outlet aperture 40, so as to cause the water pressure at the outlet aperture to increase.

A roughly vertical leaf 65 abuts the nozzle 35 adjacent to the outlet aperture 40, the leaf roughly parallel to a rear wall 70 of the sink basin 15. The leaf 65 contains a notch 80 axially located and opening downward, the notch 80 of a size to allow a handle 60 of the razor 55 to fit within the notch. The leaf is connected to one end of a roughly horizontal lever 85, the other end of the lever attached by a hinge 90 to the top 95 of the conduit 5. A pin 100 hangs from the lever 85, the pin operating the valve 30.

When the device 1 is undisturbed, as shown in FIG. 1, the weight of the lever 85 and leaf 65, and the pressure of the water in the conduit 5, cause the valve 30 to rest in the aperture 25 and shut off the flow of water through the device. When the razor handle 60 is inserted into the notch 80 and pushes the leaf 65 and the lever 85 upward, the pin 100 is pulled upward, opening the valve 30, which causes water to spray out of the outlet aperture 40 and onto the razor head 50, washing the blades within the head. The razor head 50 is easily aligned under the shower of water from the outlet aperture 40, as it is hooked by the leaf 65 when the razor handle 60 is within the notch 80. This alignment is accomplished without any damage to the razor blades from the device 1 or any damage to the device from the razor blades, as the razor blades are located in a part of the razor head 50 that is not in contact with the leaf 65.

Figure 2:
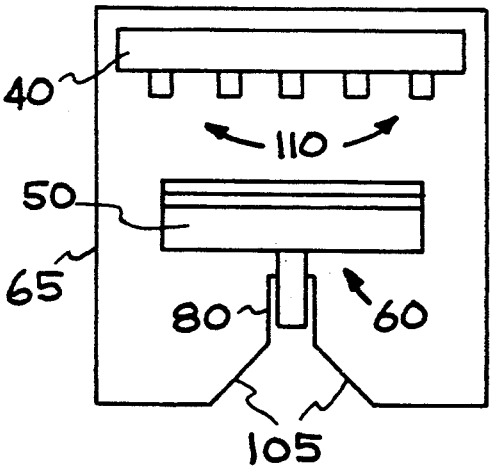
FIG. 2 is a rear view of some elements of the first embodiment of this invention.

FIG. 2 is an enlarged rear view diagram showing the leaf 65 and the notch 80. A tapered entrance 105 allows the razor handle 60 to be easily inserted into the notch 80. The outlet aperture 40 is shown to be composed of five small jets 110 that direct a high pressure shower of water to a location just behind the leaf 65, where the razor head 50 is to be aligned. The jets 110 are replaceable, as they may become clogged over time by hard water or other impurities in the water.

The device 1 is designed to be easily operated with a razor. Even if a person shaving brings the razor handle 60 to a side of the notch 80, the tapered entrance 105 funnels the handle into the notch. And as can be seen in FIG. 1, as long as the razor head 50 is behind the leaf 65, any part of the razor handle 60 can be inserted into the notch 80 to operate the device 1. Thus, a person shaving need not be exact in positioning the razor 55 at the device 1, a marked advantage for one in a hurry or without perfect hand-eye coordination, both conditions which are prevalent during the common morning shaving period.

The water flowing from the jets 110 is brought to a high pressure in several ways. First, the small area of the outlet aperture 40 composed of the row of jets 110 tends to restrict the flow of the water at the outlet aperture 40, causing the pressure within the nozzle 35 and the conduit 5 to rise. Second, when the valve 30 is shut the flow of water within the conduit is completely restricted and the pressure within the conduit 5 is caused to build to an even higher level; ideally, to the level of pressure of the water source. The valve 30 is of a tapered seal type that opens quickly which, combined with a proximity of the valve to the jets 110 and a reservoir of water within the nozzle 35, cause that very high level of pressure to be almost immediately transferred to the jets upon opening the valve, resulting in a very high pressure initial blast of water from the jets.

Figure 3:
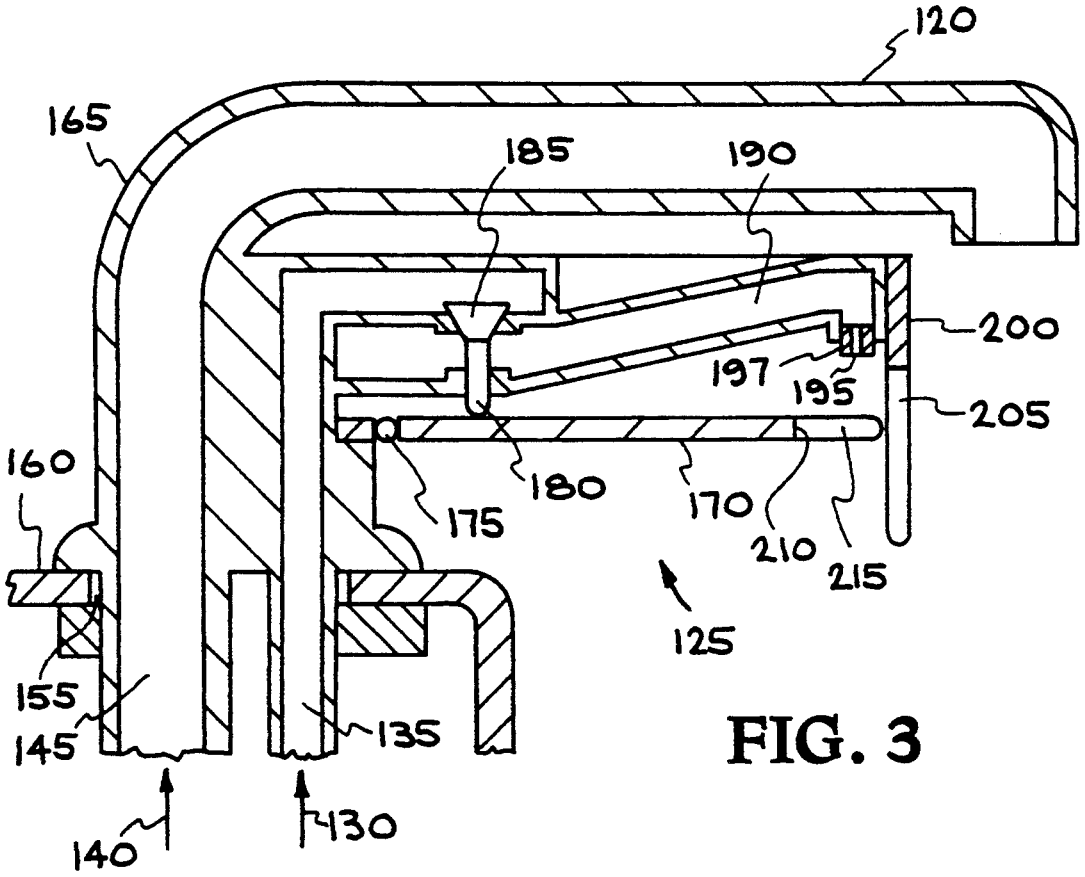
FIG. 3 is a side view of a second embodiment of this invention.

Referring now to FIG. 3, a second embodiment of this invention is shown. This embodiment discloses a faucet 120 for a sink that has been modified so that a razor cleaning device 125 is positioned underneath the faucet. A hot water source 130 is in fluid connection with a conduit 135 for the razor cleaning device 125. A mixed water source 140, containing a combination of hot and cold water as determined by adjusting hot and cold water inputs by conventional means (inputs and means not shown) is in fluid connection with a conduit 145 for the faucet 120. Both the mixed water conduit 145 for the faucet 120 and the hot water conduit 135 for the razor cleaning device 125 pass through the single aperture 155 in a rear rim 160 of the sink, alleviating the need for additional holes in the rim. Above the rear rim 160, both the mixed water conduit 145 and the hot water conduit 135 for the razor cleaning device 125 are contained within a faucet housing 165.

In this embodiment, a plank shaped lever 170 is attached by a hinge 175 to the faucet housing 165. The lever is attached to a pin 180 which operates a valve 185. When the lever 170 is pushed upward the valve 185 is opened, allowing water within the hot water conduit 135 to flow into a nozzle 190 having an inlet aperture at the valve 185 and an outlet aperture 195. A roughly vertical leaf 200 is attached to the nozzle 190 near the outlet aperture 195. The outlet aperture 195 is at a level above most of nozzle 190, so that a reservoir of water remains in the nozzle after the valve 185 has shut. The outlet aperture 195 is formed, as in the previous embodiment, of a row of jets 197. Also as in the previous embodiment, the leaf 200 contains a notch 205 axially located and opening downward. Unlike the previous embodiment, the leaf 200 does not move; a razor handle instead slides within the notch 205 to push upon the lever 170 and operate the valve 185. Because of this difference, the notch 205 is deeper than the notch 80 of the previous embodiment. The razor head is hooked by the leaf 200 so that the razor blades are aligned under the jets 197 of the outlet aperture 195.

Figure 4:
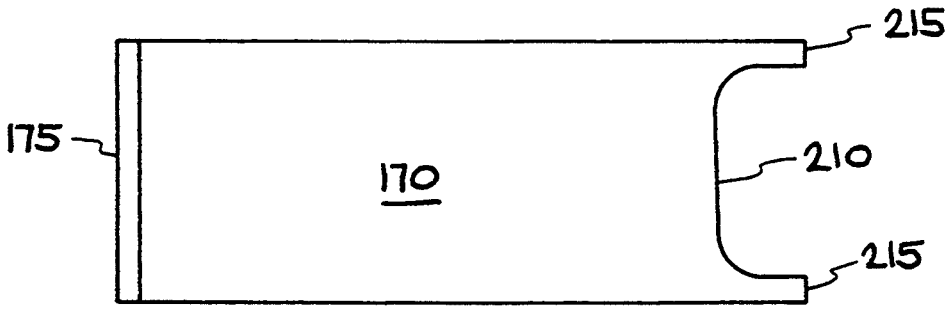
FIG. 4 is a bottom view of some elements of the second embodiment of this invention.

FIG. 4 shows a bottom view of the lever 170. A cavity 210 is shown at an end of the lever distal to the hinge 175, the cavity bordered by a pair of prongs 215. The cavity 210 is of a size so that a head of a razor containing blades can straddle the cavity, each end of the razor head pressing upon a prong 215, while the blades avoid contact with the lever 170.

When the prongs 215 are pushed upward by a head of a razor, the pin 180 is pressed upon with a force magnified by the lever and the valve 185 is opened, causing a high pressure blast of hot water to spray from the jets 197 through the cavity 210, thereby cleaning blades contained in the head. When the razor head is removed from the device 125 water pressure in the hot water conduit 135 and the weight of the lever 170 force the valve 185 closed, stopping the spray from the jets 197.

Figure 5:
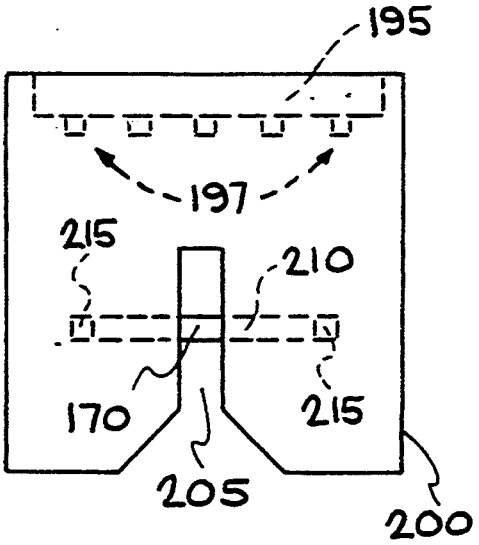
FIG. 5 is a front view diagram of some elements of the second embodiment of this invention.

FIG. 5 shows an enlarged front view diagram of the leaf 200, the notch 205, the outlet aperture 195, the jets 197 and the lever 170. The cavity 210 and the prongs 215 are shown behind the leaf 200 and notch 205. The lever 170 is in an undisturbed position in this diagram, which would leave the valve 185 closed and the device 125 off. When a razor head containing razor blades is directed upward behind the leaf 200, the notch 205 centers the razor handle, thereby causing the ends of the razor head to be aligned by the prongs 215.

Figure 6:
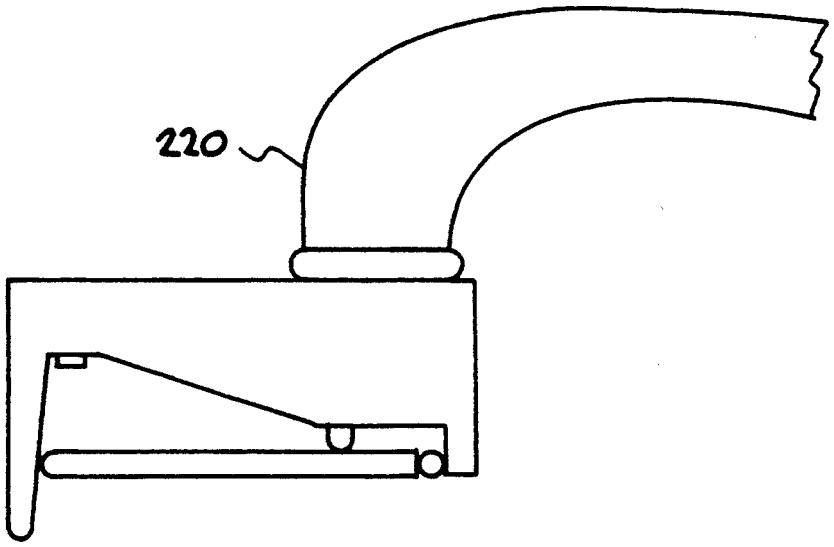
FIG. 6 is a side view of a third embodiment of this invention.
Figure 7:
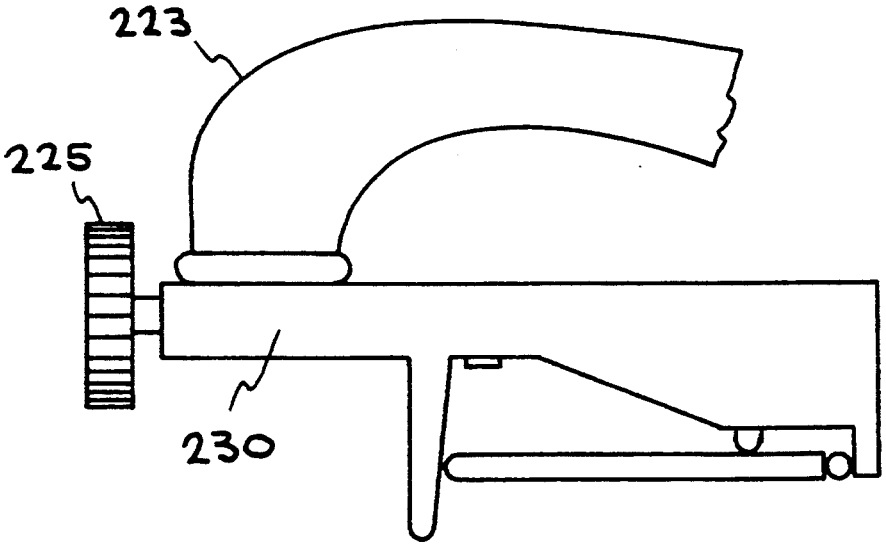
FIG. 7 is a side view of a fourth embodiment of this invention.

FIG. 6 shows a third embodiment of this invention. In this embodiment, the invention is detachably affixed to a faucet spout 220, The device of this embodiment is designed to be attached to the faucet for shaving, then detached from the faucet after shaving is complete. The attachment can be by any conventional means, but since most faucet spouts contain a threaded cylindrical aperture of a standard size, this embodiment utilizes a cylinder that threads into a standard faucet spout. FIG. 7 shows a fourth embodiment of this invention. In this embodiment the device is also affixed to a faucet spout 223, however, a knob 225 controls a valve 230 that controls whether water flows out the spout or into the razor cleaning device.

Other embodiments of the present invention incorporating the features taught here will become obvious to those skilled in the art and are intended to fall within the scope of this invention. For example, a nozzle attached to a leaf can act as a lever, causing a valve to open and shut due to a razor moving the nozzle and leaf. Or, the invention could be used in a shower. The conduit supplying fluid to the invention can be flexible, allowing the invention to be mobile. In sum, it is understood that the invention is not limited to the embodiments disclosed, but is intended to embrace any and all alternatives, equivalents, modifications and rearrangements of elements falling within the scope of the invention as defined by the following claims.

What is claimed is:

1. A device for cleaning a razor having a handle and a head containing a blade comprising:

(a) a guide having a surface with a notch, the notch piercing the guide and fitting the razor handle;

(b) a nozzle defining an inlet aperture and an outlet aperture, the outlet aperture disposed adjacent to the surface, the outlet aperture facing a location occupied by the blade with the handle in the notch and the head adjoining the surface;

(c) a lever having an end adjoining the surface and a hinge distal to the surface; and (d) a valve connected to the lever between the hinge and the end, the valve disposed adjacent to the inlet aperture, the valve having a shut state sealing the inlet aperture and having an open state allowing fluid flow through the inlet aperture, whereby moving the lever with the razor in the guide switches the valve between the shut state and the open state.

2. A device for cleaning a blade of a razor, the razor having both a handle and a head containing the blade, comprising:

(a) a body containing a conduit, the conduit having an inlet and an outlet, the inlet in liquid communication with a pressurized source of liquid;

(b) a nozzle attached to the body, the nozzle having an inlet aperture and an outlet aperture, the inlet aperture in liquid communication with the outlet of the conduit, a pressurized shower of liquid having a direction originating at the outlet aperture;

(c) a leaf located adjacent to the outlet aperture generally in a plane that is substantially parallel to the direction of the shower of liquid, the leaf containing a notch that is sized to receive the handle of the razor, the razor blade being aligned in the shower of liquid when the razor handle is in the notch and the razor head adjoins the leaf; and (d) an actuation means, operable by the razor, for switching the shower of liquid on and off.

3. A device according to claim 2, wherein the outlet aperture of the nozzle has an area smaller than that of the inlet aperture of the nozzle.

4. A device according to claim 3, wherein the outlet aperture of the nozzle comprises a plurality of jets.

5. A device according to claim 4, wherein the jets are aligned in a row.

6. A device for cleaning a blade of a razor, the razor having both a handle and a head containing the blade, comprising:

(a) a body containing a conduit, the conduit having an inlet and an outlet, the inlet in liquid communication with a pressurized source of liquid;

(b) a nozzle attached to the body, the nozzle having an inlet aperture and an outlet aperture, the inlet aperture in liquid communication with the outlet of the conduit, a pressurized shower of liquid originating at the outlet aperture and aligned with the razor blade;

(c) a valve having an open state and a shut state, the valve allowing liquid communication between the conduit and the outlet aperture in the open state and the valve obstructing liquid communication between the conduit and the outlet aperture in the shut state;

(d) means for switching the valve between the shut state and the open state with the razor;

(e) a period of time that the valve is in the shut state, the period of time that the valve is in the shut state causing the pressure of the liquid near the valve to increase; and (f) a reservoir of liquid disposed between the valve and the outlet aperture with the valve in the shut state, whereby the increase in pressure of the liquid near the valve is transferred to the shower of liquid with the valve in the open state.

7. A device for cleaning a blade of a razor, the razor having both a handle and a head containing the blade, comprising:

(a) a body containing a conduit, the conduit having an inlet and an outlet, the inlet in liquid communication with a pressurized source of liquid;

(b) a nozzle attached to the body, the nozzle having an inlet aperture and an outlet aperture, the inlet aperture in liquid communication with the outlet of the conduit, a pressurized shower of liquid originating at the outlet aperture and aligned with the razor blade;

(c) a tapered valve having an open state and a shut state, the valve sealing a hole between the conduit and the outlet aperture in the shut state and the valve exposing the hole between the conduit and the outlet aperture in the open state;

(d) means for switching the valve between the shut state and the open state with the razor; and (e) a period of time that the valve is in the shut state, the period of time that the valve is in the shut state causing the pressure of the liquid near the valve to increase.

8. A device for cleaning a blade of a razor, the razor having both a handle and a head containing the blade, comprising:

(a) a body containing a conduit, the conduit having an inlet and an outlet, the inlet in liquid communication with a pressurized source of liquid;

(b) a nozzle attached to the body, the nozzle having an inlet aperture and an outlet aperture, the inlet aperture in liquid communication with the outlet of the conduit, a pressurized shower of liquid having a direction originating at the outlet aperture;

(c) a valve having an open state and a shut state, the valve allowing liquid communication between the conduit and the outlet aperture in the open state and the valve obstructing liquid communication between the conduit and the outlet aperture in the shut state;

(d) a lever in mechanical connection with the valve; and (e) a leaf defining a notch, with a pin that is slidably encased in the leaf and partially protruding into the notch, the pin in mechanical connection with the lever and operable by the razor, such that the razor can switch the valve between the shut state and the open state with the razor blade aligned in the direction of the shower of liquid.

9. A device for cleaning a blade of a razor, the razor having both a handle and a head containing the blade, comprising:

(a) a body containing a conduit, the conduit having an inlet and an outlet, the inlet in liquid communication with a pressurized source of liquid;

(b) a nozzle attached to the body, the nozzle having an inlet aperture and an outlet aperture, the inlet aperture in liquid communication with the outlet of the conduit, a pressurized shower of liquid originating at the outlet aperture and having a direction aligned with the razor blade;

(c) a valve having an open state and a shut state, the valve allowing liquid communication between the conduit and the outlet aperture in the open state and the valve obstructing liquid communication between the conduit and the outlet aperture in the shut state;

(d) a leaf defining a notch adjacent to the shower of liquid; and (e) a lever in mechanical connection with the valve, the lever including a plank lying in a plane that is transverse to the shower direction and transverse to a plane that the leaf lies in, the plank having a movable end adjacent to the leaf, the movable end having a pair of prongs defining a cavity through which the shower of liquid travels, whereby the prongs may be pressed upon by the head of the razor with the handle disposed in the notch, rinsing the blade with the shower of liquid.

10. A device for cleaning a blade of a razor, the razor having both a handle and a head containing the blade, comprising:

(a) a body containing a conduit, the conduit having an inlet and an outlet, the inlet in liquid communication with a pressurized source of liquid;

(b) a nozzle attached to the body, the nozzle having an inlet aperture and an outlet aperture, the inlet aperture in liquid communication with the outlet of the conduit, a pressurized shower of liquid originating at the outlet aperture and having a direction aligned with the razor blade;

(c) a valve having an open state and a shut state, the valve allowing liquid communication between the conduit and the outlet aperture in the open state and the valve obstructing liquid communication between the conduit and the outlet aperture in the shut state;

(d) a leaf defining a notch fitting the razor handle and disposed adjacent to the shower of liquid; and (e) a lever in mechanical connection with the valve and attached to the leaf, whereby pressing the razor against the leaf with the handle in the notch switches the valve to the open state and rinses the blade.

11. A device for cleaning a blade of a razor, the razor having both a handle and a head containing the blade, comprising:

(a) a body containing a conduit, the conduit having an inlet and an outlet, the inlet in liquid communication with a pressurized source of liquid;

(b) a nozzle attached to the body, the nozzle having an inlet aperture and an outlet aperture, the inlet aperture in liquid communication with the outlet of the conduit, a pressurized shower of liquid originating at the outlet aperture;

(c) a valve having an open state and a shut state, the valve allowing liquid communication between the conduit and the outlet aperture in the open state and the valve obstructing liquid communication between the conduit and the outlet aperture in the shut state;

(d) a leaf defining a notch fitting the razor handle, the leaf rigidly attached to the nozzle and disposed adjacent to the shower of liquid; and (e) a lever in mechanical connection with the valve and the leaf, such that the razor can switch the valve between the shut state and the open state with the handle disposed in the notch and the razor blade aligned in the shower of liquid.

12. A device for saving water and energy while shaving with a razor having blades, a head and a handle comprising:

(a) a body containing a nozzle, the nozzle having an inlet aperture and an outlet aperture, the inlet aperture in liquid communication with a pressurized source of water, the outlet aperture smaller than the inlet aperture;

(b) a valve that can open and shut, the valve allowing liquid communication between the source of water and the outlet aperture when open, the valve preventing such communication when shut, a shower of water originating at the outlet aperture with the valve open;

(c) a lever in mechanical connection with the valve;

(d) a leaf disposed adjacent to the shower of water, the leaf containing a notch of a size fitting the razor handle; and (e) means for moving the lever with the razor to open and shut the valve with the razor handle in the notch and the razor head hooked on the leaf, such that the shower of water is aligned with at least one of the razor blades.

* * * * *